US005772490A

United States Patent [19]

Leach

[11] Patent Number: 5,772,490

[45] Date of Patent: Jun. 30, 1998

[54] BATH ENTERTAINMENT CENTER

[76] Inventor: Sheryl S. Leach, 23 Cobb Island Dr., Greenwich, Conn. 06830

[21] Appl. No.: 690,764

[22] Filed: Aug. 1, 1996

Related U.S. Application Data

[63] Continuation-in-part of Ser. No. 9,769, Jan. 27, 1993, Pat. No. 5,551,101.

[51] Int. Cl.[6] ..... A47K 3/02; A63H 33/00

[52] U.S. Cl. ..... 446/71; 4/580

[58] Field of Search ..... 446/71, 227; 4/559, 4/571.1, 572.1, 579, 580, 581

[56] References Cited

U.S. PATENT DOCUMENTS

| | | | |
|---|---|---|---|
| 2,140,902 | 12/1938 | Fischer | 4/185 |
| 3,591,867 | 7/1971 | Bernstein | 4/149 X |
| 4,047,259 | 9/1977 | Lotis | 15/104.92 |
| 4,356,575 | 11/1982 | Terry | 4/559 |
| 4,625,344 | 12/1986 | Howard | 4/581 |
| 4,937,897 | 7/1990 | Barnabie | 4/580 |
| 5,313,675 | 5/1994 | Tinen | 4/586 |
| 5,381,564 | 1/1995 | Carroll | 4/559 |
| 5,551,101 | 9/1996 | Leach | 4/580 |

FOREIGN PATENT DOCUMENTS 2199740 7/1988 United Kingdom .

OTHER PUBLICATIONS

PCT Published Application No. WO 94/16608 Published on Aug. 1994 (Leach).

The Right Start Catalog, Spring, 1992, Winter 1992 and Winter 1993, p. 51, Item 250.

One Step Ahead Catalog, Holiday 1992 and Winter/Spring 1993, p. 26, item g.

*Primary Examiner*—William H. Grieb

*Attorney, Agent, or Firm*—Elizabeth R. Hall; Winstead Sechrest & Minick, P.C.

[57] ABSTRACT

A bath entertainment center is disclosed that provides a portable device for converting a typical bathtub into an educational and entertaining event for infants or preschoolers. The bath entertainment center is designed to provide an interactive surface on the inside of the bathtub where toys or other objects can be removably attached. The interactive surface is removable and may be exchanged with other interactive surfaces. The bath entertainment center provides a system for catching fluids that splash over the top rim of the bathtub and a padded surface to cover the top rim of the bathtub to ease the discomfort of the parent or care giver who must lean over the bathtub.

22 Claims, 6 Drawing Sheets

BATH ENTERTAINMENT CENTER

This is a continuation-in-part of application Ser. No. 08/009,769 filed on Jan. 27, 1993 now issued as U.S. Pat. No. 5,551,101 on Sep. 3, 1996.

TECHNICAL FIELD OF THE INVENTION

The present invention relates to a bath entertainment center and more particularly to an entertainment center that provides an interactive surface adapted to interact with exchangeable items.

BACKGROUND OF THE INVENTION

Bathing an infant or preschooler is typically a messy and uncomfortable process for its participants, the child and the parent or care giver.

Many mothers have found that it is often a difficult task to induce their infant to enter a bathtub filled with water. One solution to this problem is to provide bathtub toys or items of interest which will attract the child's attention and render the evening bath more enjoyable.

Numerous attempts have been made to provide an enjoyable atmosphere for bathing infants. For example, floating toys are commonly used to attract and entertain infants. Other approaches have included a bathtub designed for infants having toys and toy figures mounted on the top rim of the bathtub for the child to look at and play with during the bathing process. Such a system is described in U.S. Pat. No. 3,029,551. Another bathtub toy, described in U.S. Pat. No. 3,213,516, is a playboard designed to sit over the top of both sides of a standard bathtub. The playboard provides a number of apertures of predetermined sizes and shapes for receiving a variety of elements or toys. In addition, U.S. Pat. No. 3,577,675 describes a bathing toy mounted on the inside wall of a bathtub that includes a water pump to provide a stream of water for activating selected water-powered toys and activities.

Not only must parents deal with entertaining infants during the bathing process, but they must also deal with the uncomfortable aspect of leaning over a bathtub while bathing the infant. The top rim of the bathtub is cold and hard and pinches the parents underarms and chest and presses on the rib cage throughout the bathing process. Furthermore, giving an infant a bath is always a wet, and probably sudsy, experience for both the parent and the bathroom floor. Spilling soapy water on the bathroom floor increases the chances that the parent or child may fall and creates an unsafe bathing environment.

In addition, a parent must be very careful to protect the child during the bathing process. For example, a child or a parent will commonly want an item that is not localized within the parent's reach; yet it is unsafe for a parent to leave a child for even an instant to retrieve an item from elsewhere. Furthermore, the parent must lift the child totally out of the bathtub before beginning the drying off process because the rim of the bathtub is very slippery when wet and the child could be injured if he/she were to fall.

Even when a parent works out a safe and convenient system for bathing an infant at home, the same bathing process can become extremely awkward and uncomfortable whenever that parent travels and must bathe the infant in a hotel bathtub or in bathtubs at their relatives or friends homes.

Accordingly, a need exists for an economical, portable means of converting a typical bathtub into a more user-friendly and safe environment for the parent, as well as, an entertaining environment for the infant or preschooler.

SUMMARY OF THE INVENTION

The problems discussed above have been solved in the present invention which provides a portable, self-contained means for converting a typical bathtub into a safe, entertaining, more user friendly environment for participants in the bathing process. Participants in the bathing process include infants or preschoolers and their parents.

In accordance with a preferred embodiment of the invention, a bath entertainment center that fits over the top rim of a bathtub with its sides extending downward comprises one side on the outside of the bathtub, one side on the inside of the bathtub, and a top section positioned over the rim of the bathtub. One embodiment of the bath entertainment center has an external flap (i.e., the side of the bath entertainment center that hangs on the outside of the bathtub) that is designed to collect and contain fluids that spill over the bathtub during bathing, an internal flap (i.e., the side of the bath entertainment center that hangs on the interior of the bathtub) having an interactive surface adapted to interact with exchangeable items, and a padded top section (i.e., the section that is positioned over the top rim of the bathtub when the bath entertainment center is in use); the bath entertainment center being designed to provide a safer and more comfortable bathing environment for children and their parents. The bath entertainment center increases the safety of the bathing experience by providing padded areas with traction-enhancing ridged surfaces to reduce the chance of falling and the degree of injury if a child does fall.

The foregoing has outlined rather broadly several aspects of the present invention in order that the detailed description of the invention that follows may be better understood. Additional features and advantages of the invention will be described hereinafter which form the subject of the claims of the invention. It should be appreciated by those skilled in the art that the concept and a specific embodiment disclosed herein may be readily utilized as a basis for modifying or designing other devices for carrying out the same purpose as the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 2A illustrates an outside isometric view of one embodiment of the bath entertainment center as it fits over a side of a bathtub with a means for collecting liquid interacting with a frame shown in dotted line;

FIG. 2B shows one embodiment of a frame in a cross-section of the bath entertainment center illustrated in FIG. 2A taken along section 2B—2B;

FIG. 2C shows an alternative embodiment of a frame for use with the bath entertainment center of FIG. 2A;

DETAILED DESCRIPTION OF THE PREFERRED EMBODIMENT

Figure 1:
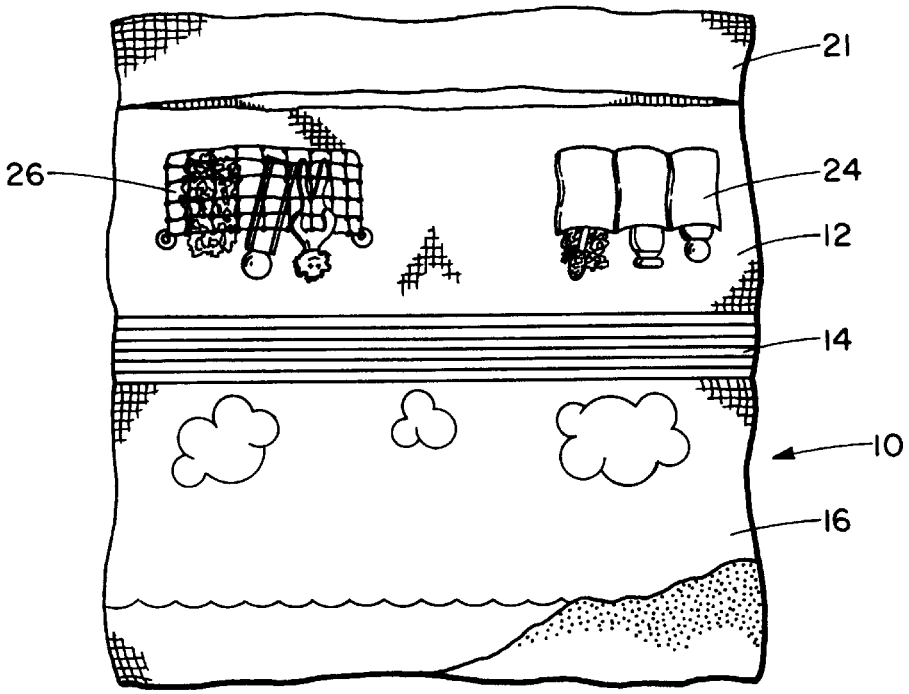
FIG. 1 shows a top view of one embodiment of the bath entertainment center when it is laid out flat.

The problems discussed above, inherent in bathing infants or preschoolers, have been solved in several embodiments of the present invention which provide a means for converting a bathtub into a safe, more enjoyable environment for the child and the parent or care giver.

With reference to the drawings, like reference characters designate like or similar parts throughout the drawings.

Referring to FIG. 1, one embodiment of a bath entertainment center 10 is illustrated that it is designed to fit over the top rim of a bathtub with its sides extending downward, one side on the outside of the bathtub and one side on the inside of the bathtub. The bath entertainment center 10 is made of a flexible, relatively water-impenetrable material. The bath entertainment center 10 has an external flap 12 (i.e., the side of the bath entertainment center that hangs on the outside of the bathtub), a top section 14 (i.e., the section of the bath entertainment center that is positioned over the top rim of the bathtub when the bath entertainment center is in use), and an internal flap 16 (i.e., the side of the bath entertainment center that hangs on the inside of the bathtub).

FIG. 2A shows the bath entertainment center 10 positioned over the top rim 22 of the bathtub 20. The external flap 12 hangs down on the outside of the bathtub 20, when the bath entertainment center 10 is positioned over the top rim 22 of the bathtub 20. Attached to the external flap 12 is a means of collecting and containing liquids that overflow over the rim 22 of the bathtub 20 during the bathing process. A preferred embodiment of this collecting means is an adaptation to the bottom outside edge of the bath entertainment center 10 to form a pocket 21. Pocket 21 is designed to catch overflow suds and liquid as they splash over the top rim 22. By protecting the bathroom floor from getting wet, the risk of a parent or infant slipping or falling on a wet soapy floor is dramatically reduced.

Figure 3:
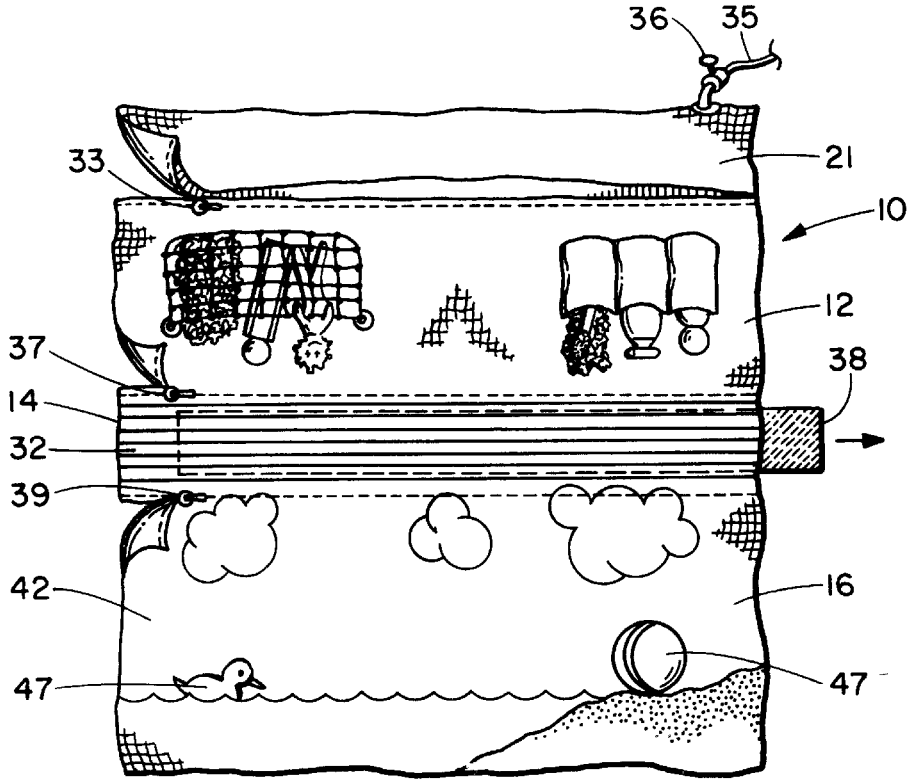
FIG. 3 shows a top view of an alternative embodiment of the bath entertainment center when laid out flat.

Pocket 21 may be a permanent part of the bath entertainment center 10 or it may be detachable as illustrated in FIG. 3. Although there are a number of attachment means known in the art, a preferred embodiment uses a zipper 33 to attach or remove the pocket 21 from the bath entertainment center 10. Other means would include a pressure engaged zip-lock seal, snaps, the well known hook and loop mechanism commercially available under the trade designation VELCRO, and the like. Pocket 21 may also be designed with a drain 35 to divert the overflow fluids to a desired location. Drain 35 may have an optional valve 36 to allow the parent to close off the drain and remove it when the drain is not in use.

Pocket 21 may also be designed to receive a frame 25, or pocket extension, two embodiments of which are shown in FIGS. 2B and 2C. Frame 25 will ensure that the pocket 21 remains open throughout the bathing process. Frame 25 may be permanently attached to the bath entertainment center 10 as illustrated in FIG. 2C. One embodiment of frame 25 that is permanently attached to external flap 12 includes an accurate member 210 that is pivotally attached to arm 220 by an attachment means such as pin 225. Arm 220 is also pivotally attached to section 213 of external flap 12 by pin 219. Arm 220 can pivot upward into slot 217 of section 213, when frame 25 needs to be collapsed for storage of the bath entertainment center 10. Frame 25 cannot pivot downward as it is stopped by section 213.

Alternatively, frame 25 may be inserted into pocket 21 when the bath entertainment center 10 is in use. Inserted frame 25 may be composed of one or more pieces. A preferred embodiment of frame 25 is illustrated in FIG. 2B. This embodiment has an arcuate member 210 that has an arm 220 rivetted to it with a pin 225 in such a manner that arcuate member 210 is freely movable. Arm 220 includes a base 223 that fits against external flap 12 on the inside of the pocket 21.

Frame 25 is preferably made of a relatively inflexible material such as plastic or metal. Preferred embodiments of the frame 25 have rounded ends such that if a person were to fall into the side of the bathtub 20 against the pocket 21, frame 25 would not pierce the pocket 21 and injure the person.

External flap 12 may also have a number of repositories for shampoo, soap, medications, and the like as illustrated in FIG. 2A. For example, preformed receptacle 24 may be attached to external flap 12 to hold shampoo, sponges, brushes, and the like. Other alternatives include a netting 26 that may be attached to external flap 12 by rings 27, or by other devices. External flap 12 may have multiple pockets, receptacles, hooks, rings, and the like for attaching or storing useful items for the bathtub. Providing a number of repositories for items needed during the bathing process within a parent's reach, avoids a parent's desire to momentarily direct his or her attention away from the infant to retrieve such an item.

It should be noted that external flap 12 can be omitted by those who desire not to have their bathing area appear modified. In such a situation, flap 12 can be omitted permanently, or it can be attached at bath time. External flap 12 can be attached or removed using an attachment means 37 shown in FIG. 3. A variety of attachment means 37 are known in the art such as zippers, snaps, VELCRO, and the like. The removal of flap 12 yields a "clean" outer surface to bathtub 20.

Figure 4A:
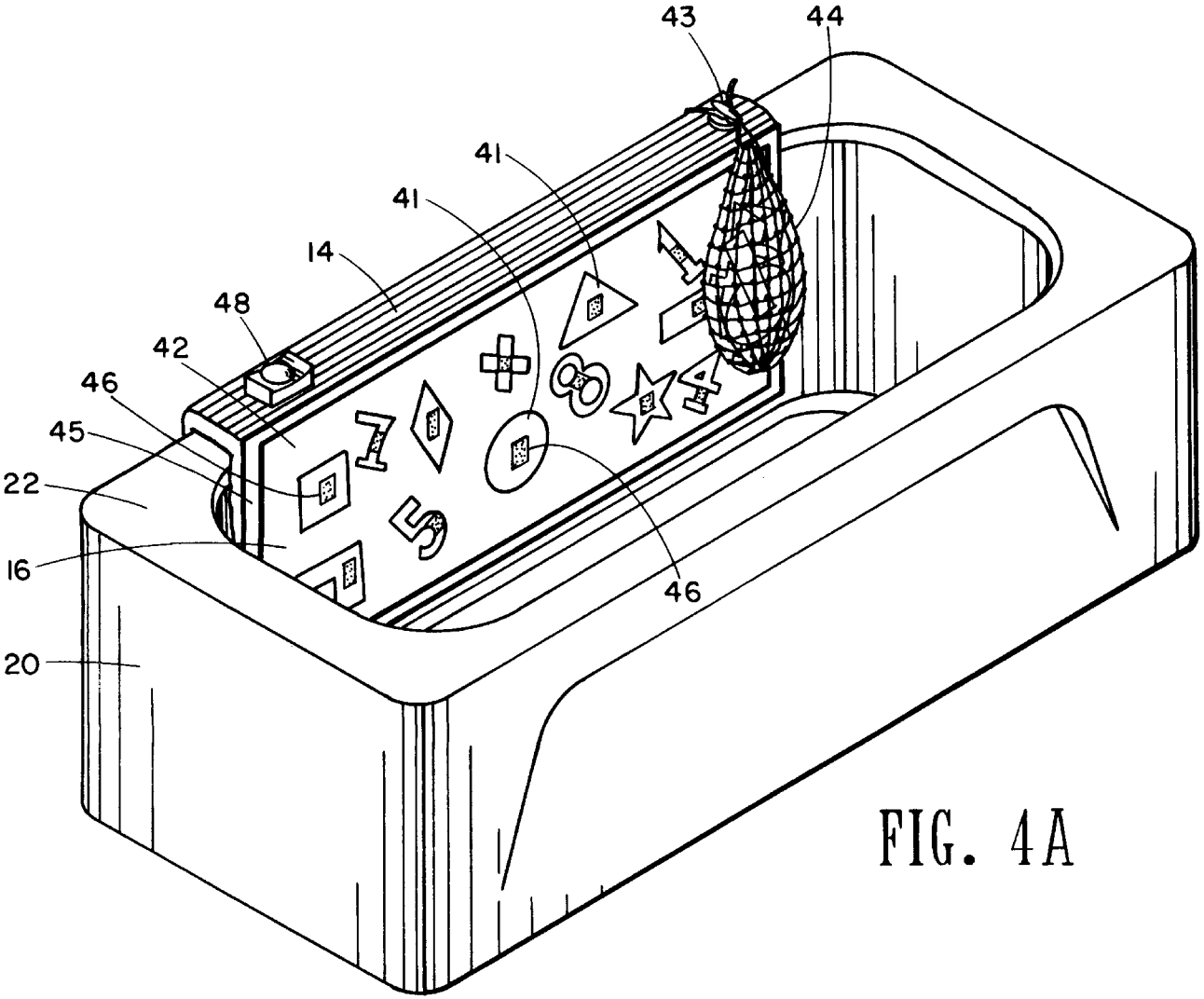
FIG. 4A shows an isometric view of an alternative embodiment of the bath entertainment center, from inside the bathtub, as it fits over the side of a bathtub.

FIG. 4A shows the internal flap 16 as it hangs down on the inside of bathtub 20 when the bath entertainment center 10 is positioned over the top rim 22. Internal flap 16 provides a means for removably associating items with bath entertainment center 10, for the infant or preschooler's entertainment and/or education.

Internal flap 16 includes an interactive surface 42 that faces the inside of bathtub 20 when the bath entertainment center 10 is positioned over top rim 22. Interactive surface 42 can have a large number of embodiments which can be used by a child to create stories, pictures, or that can be used to provide a learning experience. Interactive surface 42 may be decorated with scenes, cartoon characters, or pictures of animals (including those that make a sound or series of sounds when poked or prodded).

Interactive surface 42 may have a portion, or all, of its surface adapted to stick to a portion of the surface of an exchangeable item 47 by the well-known hook and loop mechanism VELCRO or by a number of other means. For example, FIG. 3 shows one embodiment of the interactive surface 42 where the entire surface of the interactive surface 42 is a beach scene that has been adapted to removably affix exchangeable items 47. A child may place a variety of soft devices, or exchangeable items 47 made to stick to interactive surface 42, anyplace on surface 42. Such items 47 may be shaped as a boat, bucket, shovel, beach ball, sun, clouds, boy, girl, dog, kite, and the like. This embodiment of the interactive surface 42 allows a child to create his/her own picture and to formulate stories to go along with the created picture, thus stimulating the child's imagination.

FIG. 4A, on the other hand, illustrates an alternative interactive surface 42. This embodiment of surface 42 includes a number of templates or predetermined indicia 41 (such as numbers, letters, shapes, etc.) with an interactive strip 46, localized within each indicia 41, that will interact with a corresponding interactive strip on exchangeable items 47. In this embodiment of interactive surface 42, the child can identify and place an item 47 that is a preformed graphical representation of indicia 41 on indicia 41. Exchangeable items 47 may be detached from interactive strip 46 and reattached later. Such attachments and detachments can occur a large number of times without damaging the bath entertainment center 10 or exchangeable items 47.

Figure 4D:
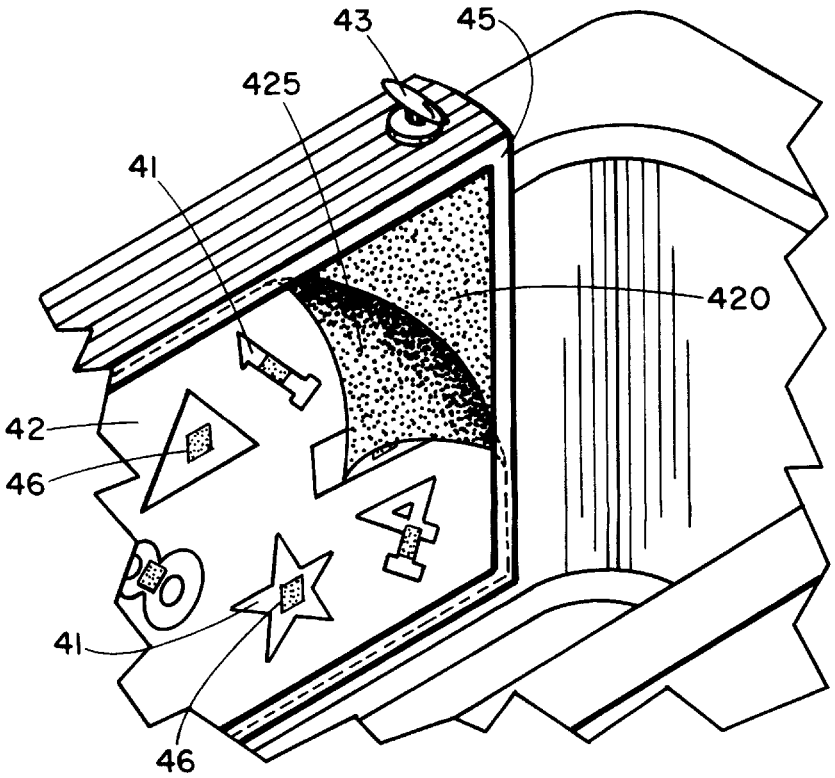
FIG. 4D shows an isometric pictorial of a breakaway section of FIG. 4A.
Figure 4B:
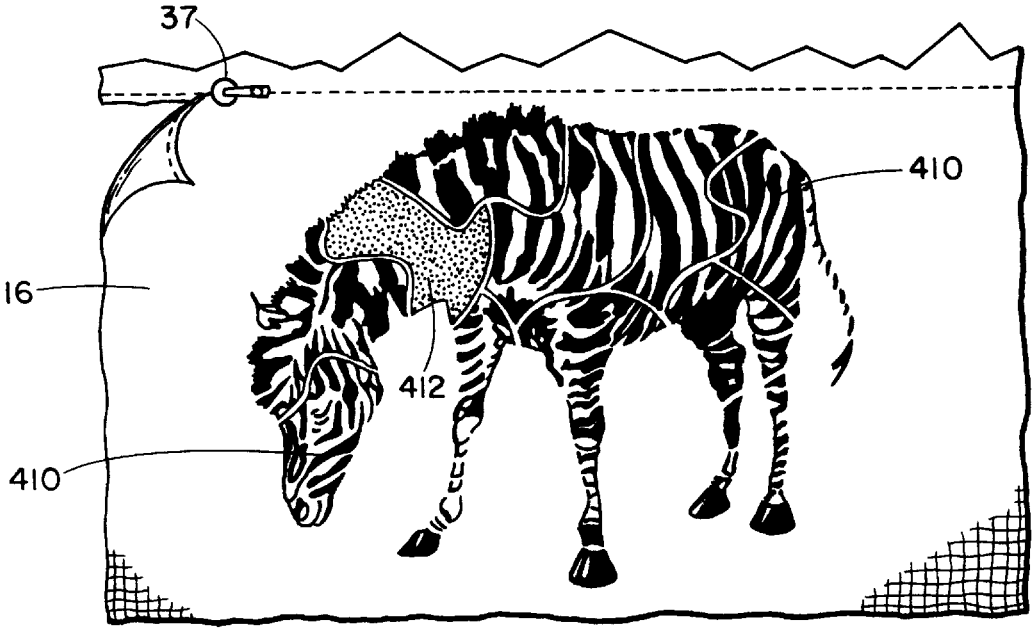
FIG. 4B shows an alternative embodiment of an internal flap for use with the bath entertainment center of FIG. 3.

FIG. 4B shows an alternative embodiment of the interactive surface 42 where interactive surface 42 represents only a portion of internal flap 16 which is adapted to provide a background 412 for adhering a number of interlocking puzzle pieces 410 that fit together to create a picture or scene. The hand and eye coordination and recognition manipulatives of selecting the appropriate exchangeable item 47 for a particular indicia on the interactive surface 42 or of fitting together the pieces of a puzzle will help improve a child's thinking and solving skills, coordination skills, and recognition skills. In addition, these activities provide entertainment for the child during the bathing process.

Figure 4C:
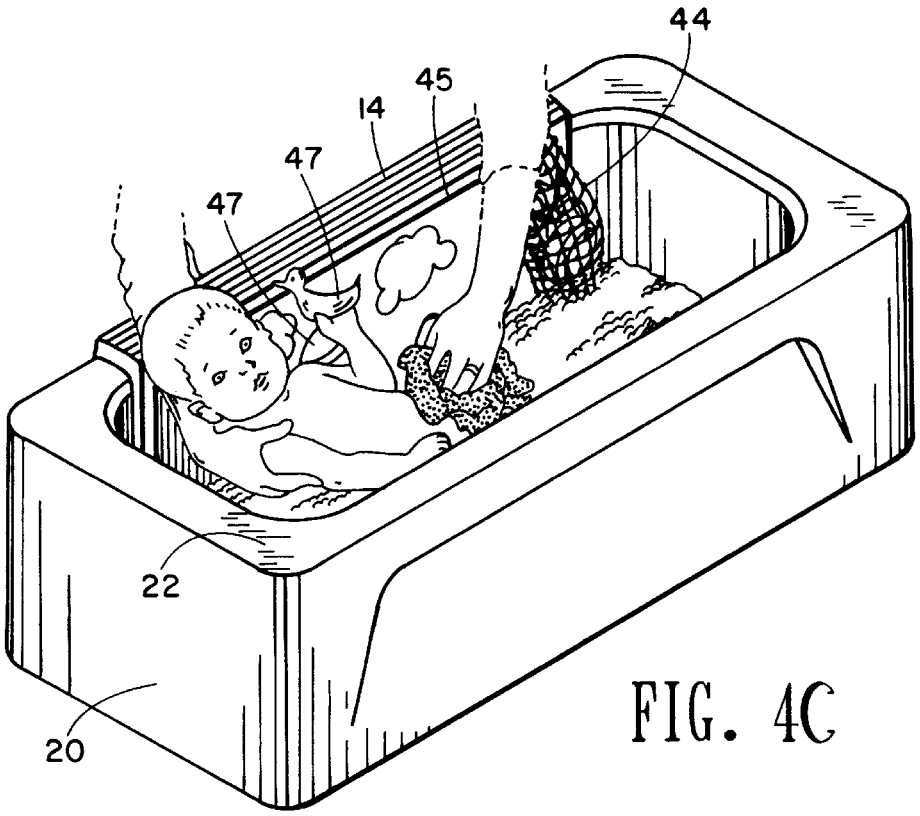
FIG. 4C shows one embodiment of the bath entertainment center from inside a bathtub in which a child is being bathed.

FIG. 4C shows a bathing child with an exchangeable item 47 in his/her hand ready to attach the item 47 to the interactive surface 42.

One embodiment of interactive surface 42 forms a permanent part of internal flap 16, such as illustrated in FIG. 1. In this embodiment the bath entertainment center has a permanently attached internal flap 16 with an interactive surface 42 incorporated therein.

Another embodiment of the present invention provides internal flap 16 with an attaching means 39 as illustrated in FIGS. 3 and 4B that will allow internal flap 16 to be removed or to be attached as desired. A variety of attaching means such as zippers, snaps, VELCRO, and the like may be used. This embodiment allows the parent to interchange different internal flaps 16 having different interactive surfaces 42.

This embodiment provides a parent or a child care center with the option of selecting a large number of interactive surfaces 42 for one or more children. A parent may also want to change the interactive surface 42 as the child ages. For example, a preschooler may prefer a more complicated puzzle or educational interactive surface 42 than an infant. The embodiment of interactive surface 42 pictured in FIGS. 3 and 4B allows the parent to simply unzip one interactive surface 42 and zip on another.

An alternative embodiment of the bath entertainment center 10 has an internal flap 16 that is a permanent part of the bath entertainment center 10 with an interchangeable interactive surface 42, an example of which is illustrated in FIG. 4A. A variety of mechanisms may be employed to exchange different interactive surfaces 42 on an internal flap 16. For example, an interactive surface 42 may have a back side that is adapted to reversibly interact with the side of internal flap 16 that faces the inside of bathtub 20 so that a parent may change interactive surface 42 without removing internal flap 16. For example, internal flap 16 and interactive surface 42 may be made to snap together, to stick together with VELCRO and the like. In a preferred embodiment, illustrated in FIG. 4A, the internal flap 16 has an edging 45 that is designed to accept the outside edges of interactive surface 42. When the edges of interactive surface 42 are inserted under edging 45 of internal flap 16, interactive surface 42 is available for a child to play with during the bathing process. FIG. 4D shows one embodiment of an interactive surface 42 inserted under edging 45 of internal flap 16 in which the backside 425 of interactive surface 42 is adapted to specifically interact with the inside surface 420 of internal flap 16.

FIG. 3 shows the top of the bath entertainment center 10 as if the bath entertainment center were laid out flat. Top section 14 of bath entertainment center 10 is located between and adjoins external flap 12 and internal flap 16. Top section 14 fits over top rim 22 of bathtub 20 as illustrated in FIGS. 2A and 4A.

Figure 6:
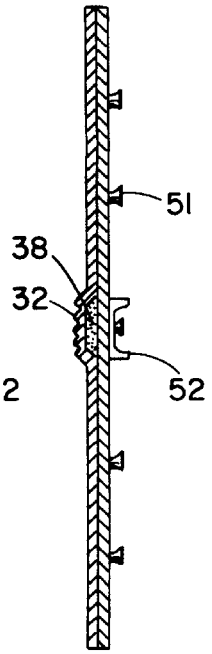
FIG. 6 shows a cross-section of the bath entertainment center illustrated in FIG. 5 taken along section 6—6.
Figure 7A:
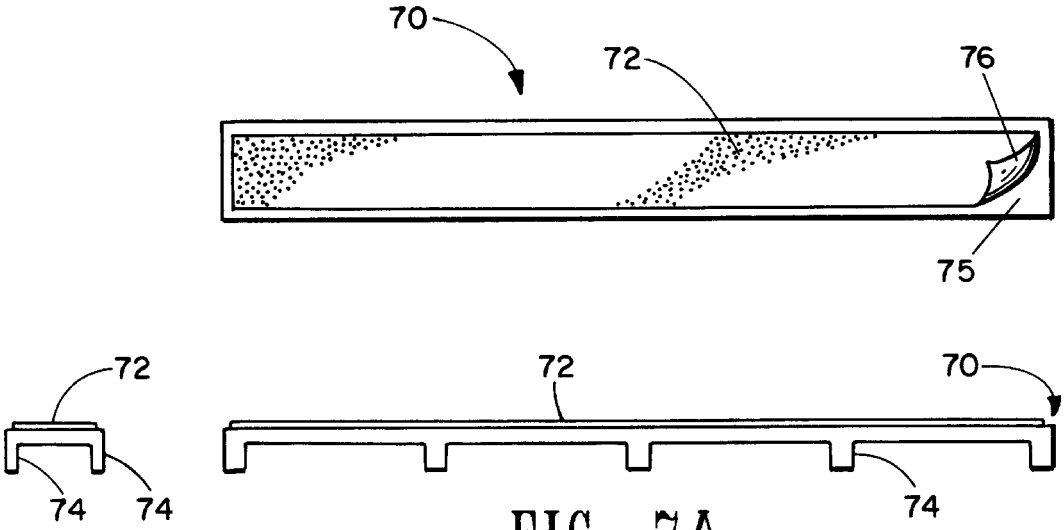
Figure 7B:
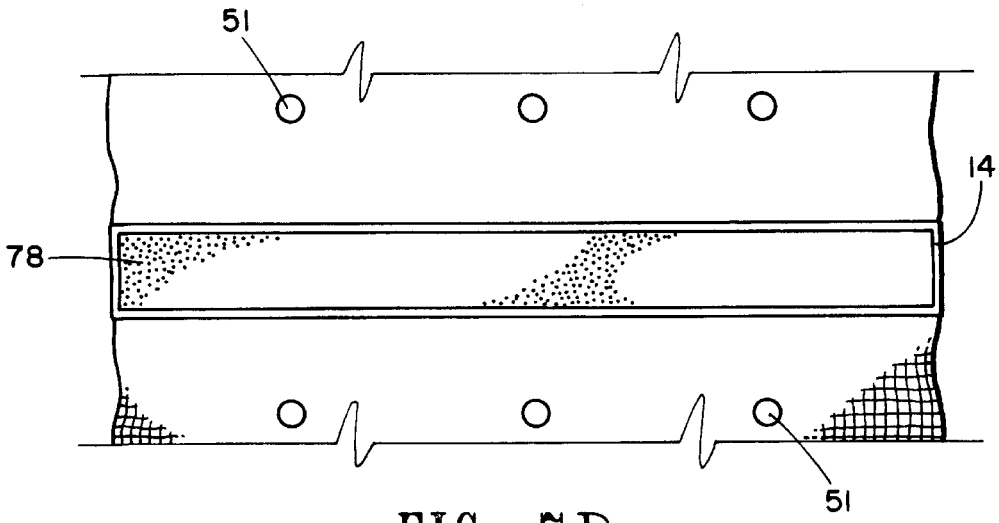

Top section 14 may be padded and, if desired, ridged as illustrated in FIG. 3. Although the entire bath entertainment center 10 may be padded, FIGS. 3 and 6 show a preferred embodiment of bath entertainment center 10 in which padding 38 traverses the width of the top section 14 of the bath entertainment center 10 for the comfort of the parent or care giver who must lean over top rim 22 of bathtub 20 during the bathing process. Padding 38 may be designed to slip out, if desired, so that it can be renewed from time to time as illustrated in FIG. 3. Padding 38 may be renewed by either washing padding 38 and replacing it in top section 14, or by replacing padding 38 with new padding.

In one embodiment of the invention, ridged surface 32, in juxtaposition to the padding 38 (see FIGS. 3 and 6), also traverses the width of top section 14. Ridged surface 32 provides a friction-enhancing surface on top section 14 that decreases the risk that a child will slip or fall if he/she was to sit on top section 14 during the drying off process. In addition, ridged surface 32, or any other type of friction-enhancing surface, provides traction to assist a child from slipping while standing up. Padding 38 and ridged surface 32 are designed to provide a safer bathing experience by reducing the chance of falling and the degree of injury if a child did fall.

FIGS. 2A and 4A also illustrate a couple of optional features for top section 14 such as a built-in soap dish 48 and a hook 43. Hook 43 may be used to hang net 44 that stores toys, etc. in order to keep those toys and other items readily accessible to the child inside of the bathtub. Hook 43 is designed to hang net 44 either inside or outside of bathtub 20. Providing a localized repository for toys and other items needed during the bathing process will ensure that the parent does not turn away from the bathing child to retrieve a toy or other item from another location.

Figure 5:
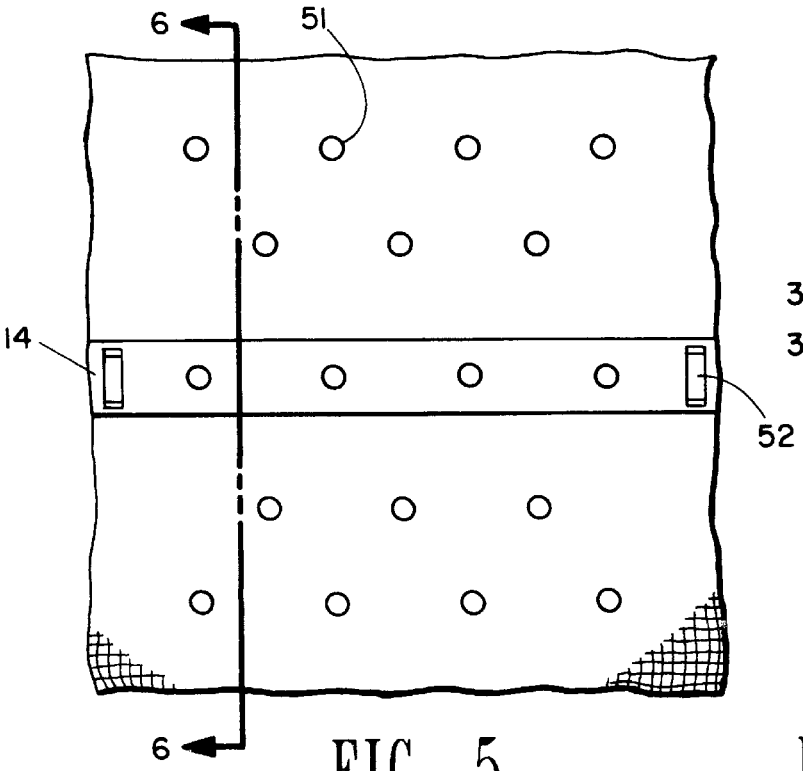
FIG. 5 shows an underside view of one embodiment the bath entertainment center when laid out flat.

FIG. 5 shows an underside of bath entertainment center 10 which has an essentially non-slip surface. This non-slip surface may cover the entire surface of bath entertainment center 10 by reason of the material from which it is manufactured, or because of the presence of an applied material that provides a non-slip surface coextensive with the underside of bath entertainment center 10. Providing a non-slip surface on the underside of bath entertainment center 10 will help keep the bath entertainment center in place even when a parent leans over it or when an infant or preschooler holds on to it while standing up. A preferred embodiment of an essentially non-slip surface is provided by suction cups 51 shown in FIGS. 5 and 6.

In addition, FIG. 5 shows, attached to the underside of top section 14, an optional mounting device 52 designed to fit over top rim 22 and further stabilize bath entertainment center 10 when it is positioned over top rim 22 of bathtub 20. FIG. 6, a cross-section of bath entertainment center 10 taken along Section 6—6 of FIG. 5, shows mounting device 52 in juxtaposition to padding 38 and ridged surface 32. Mounting device 52 may traverse the width of top section 14, or it may be located in areas close to each side of the bath entertainment center as illustrated in FIG. 5.

Figure 7A:
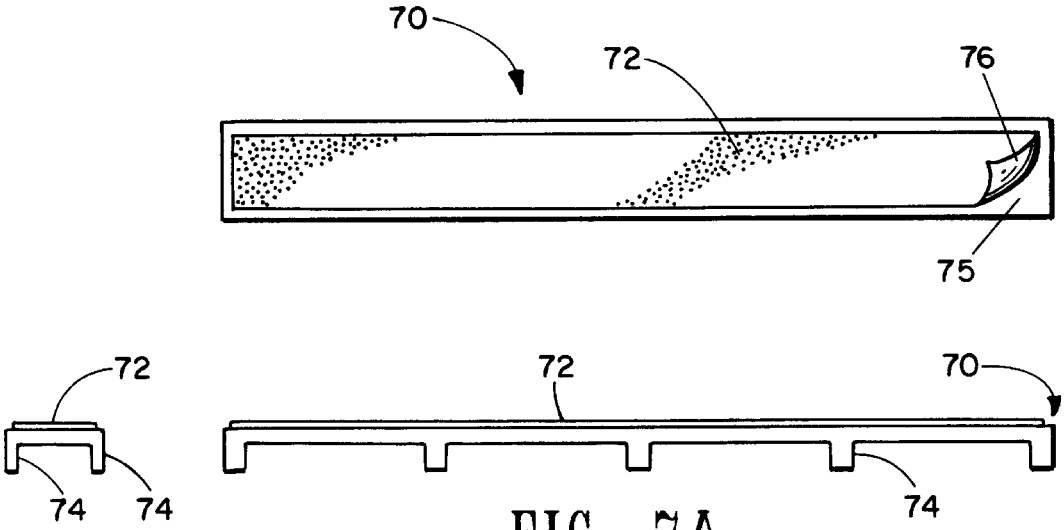
FIG. 7A shows a frontal view, a side view, and a top view of one embodiment of a mounting bar that fits over the top rim of the bathtub and interacts with the underside of the top section of the bath entertainment center.
Figure 7B:
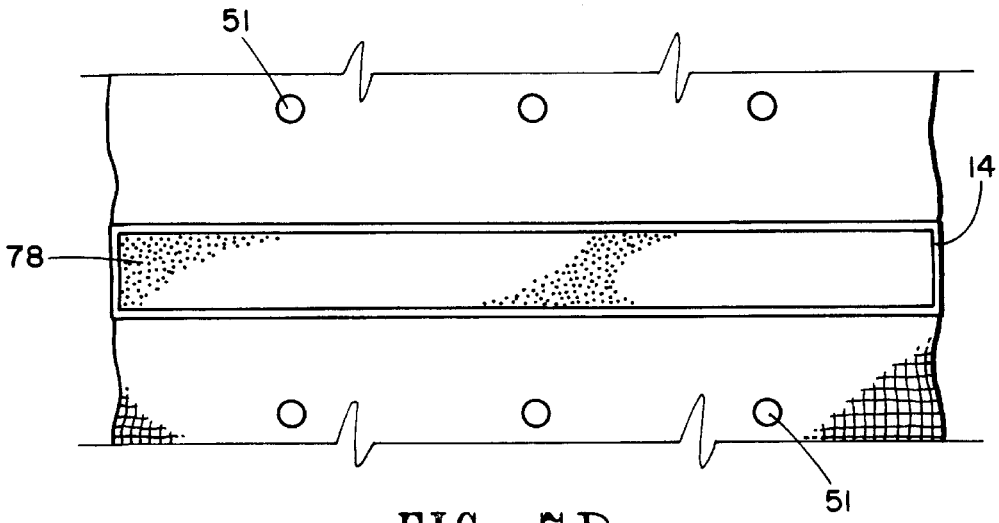
FIG. 7B shows the underside of the top section of one embodiment of the bath entertainment center.

Mounting device 52 may be preformed and a permanent part of bath entertainment center 10, or it may represent a separate mounting bar 70 such as illustrated in FIG. 7A. Mounting bar 70, as shown in FIG. 7A, is an optional apparatus that is designed to fit snugly over the top rim 22 of a bathtub 20 and is adapted to specifically interact with the underside of top section 14 to stabilize the bath entertainment center 10 on the top rim of the bathtub 20. For example, mounting bar 70 may have a surface area 72 that is either a permanent part of mounting bar 70 or is attached to the top side 75 of mounting bar 70 by an adherent such as an epoxy glue placed on the back side 76 of surface area 72 and pressed onto the top side 75 of mounting bar 70. Surface area 72 may be magnetized, or otherwise designed to interact and/or adhere to a section 78 on the underside of top section 14 (shown in FIG. 7B). Surface area 72 and section 78 may be adapted to specifically interact with each other by incorporating magnets, VELCRO, snaps, and the like onto surface area 72 and section 78 that will interact and/or reversibly adhere to each other.

Bath entertainment center 10 advantageously may be made of a flexible material so that it can be rolled up like a bedroll or folded for storage when not in use or for traveling. When bath entertainment center 10 is rolled up or folded it is easily stored in its own carrying case along with its accessories. For example, a carrying case may be designed to carry bath entertainment center 10, a frame 25, a number of exchangeable items 47, several interactive surfaces 42, mounting bar 70, etc. Thus, bath entertainment center 10 can easily be packed in its carrying case and carried from one place to another such that it is readily accessible to convert any regular bathtub into an environment that is safer and more user friendly for bathing infants or preschoolers.

While preferred embodiments of the invention have been shown and described, it will be apparent to those skilled in the art that the conception and the specific embodiments disclosed may be readily utilized as a basis for modifying or designing other structures for carrying out the same purpose as the present invention. It should also be realized by those skilled in the art that such equivalent constructions do not depart from the spirit and scope of the invention as set forth in the appended claims.

What is claimed is:

1. A device used in the bathing of a child, said device comprising:

a section traversing a portion of a width of said device, said section positionable over a top rim of a bathtub;

an external flap attached to said section and extending down on the exterior of said bathtub; and an interior flap attached to said section and extending down on the interior of said bathtub, said interior flap having an exchangeable interactive surface, said interactive surface including a means for removably affixing a plurality of objects to said surface.

2. The device of claim 1, wherein said external flap includes a means for collecting liquids spilled over said bathtub, said collecting means localized at a bottom edge of said external flap and interacting with a frame.

3. The device of claim 2, wherein said collecting means is removably attached to said device.

4. The device of claim 2, wherein said collecting means has a drain.

5. The device of claim 1, wherein said external flap includes a means for storing articles for use during the bathing process.

6. The device of claim 1, wherein said external flap is detachable.

7. The device of claim 1, wherein said device is composed of a flexible material that can be rolled up.

8. The device of claim 1, wherein said section includes a pad that is removable.

9. The device of claim 8, wherein said removable pad is washable.

10. The device of claim 1, wherein said section includes a soap dish.

11. The device of claim 1, wherein said device further comprises a traction-enhancing surface traversing a width of said section in juxtaposition with said section, said traction-enhancing surface on a top side of said section.

12. The device of claim 11, wherein said traction-enhancing surface is a ridged surface.

13. The device of claim 1, further comprising a plurality of suction cups attached to an underside of said device.

14. The device of claim 1, further comprising means for securely mounting said device on said top rim of said bathtub.

15. The device of claim 14, wherein said mounting means is permanently attached to an underside of said section.

16. The device of claim 14, wherein said mounting means is removably attached to an underside of said section.

17. The device of claim 16, wherein said mounting means has a top surface that is adapted to specifically interact with said underside of said section.

18. The device of claim 1, wherein said removably affixed objects are interlocking pieces of a puzzle.

19. The device of claim 1, wherein said interactive surface has a predetermined indicia on a one side thereof, said one side facing the interior of said bathtub.

20. The device of claim 19, wherein said removably affixed objects are preformed graphical representations of said predetermined indicia.

21. A device used in the bathing of a child, said device comprising:

a section traversing a portion of a width of said device, said section positionable over a top rim of a bathtub;

means for securing said section on said top rim; and a removable interior flap attached to said section and extending down on the interior of said bathtub, said interior flap having an interactive surface that will removably affix an object.

22. A device used in the bathing of a child, said device comprising:

a section traversing a portion of a width of said device, said section positionable over a top rim of a bathtub;

a detachable external flap attached to said section and extending down on the exterior of said bathtub, said external flap having a pocket at a bottom edge of said external flap, said pocket adapted to interact with a collapsible frame; and an interactive surface extending down on the interior of said bathtub, said interactive surface having a means for removably affixing an object.

* * * * *